United States Patent [19]

Dewsnap et al.

[11] 4,084,798

[45] Apr. 18, 1978

[54] COOLING SYSTEMS FOR METAL ARTICLES

[75] Inventors: Ronald F. Dewsnap; Andrew D. Higgins; David E. Beard, all of Sheffield, England

[73] Assignee: British Steel Corporation, London, England

[21] Appl. No.: 611,081

[22] Filed: Sep. 8, 1975

[30] Foreign Application Priority Data

Sep. 10, 1974 United Kingdom ..... 39446/74

[51] Int. Cl.[2] ..... C21D 1/62

[52] U.S. Cl. ..... 266/131; 134/199; 148/153; 266/114

[58] Field of Search ..... 148/153; 266/112, 113, 266/114, 130, 131; 134/64 R, 122 R, 199

[56] References Cited

U.S. PATENT DOCUMENTS

| | | | |
|---|---|---|---|
| 2,009,078 | 7/1935 | Ziska | 134/199 X |
| 2,067,436 | 1/1937 | Coberly | 266/112 X |
| 2,287,825 | 6/1942 | Postlewaite | 266/112 X |
| 2,565,855 | 8/1951 | Jordan | 134/199 X |
| 3,531,334 | 9/1970 | Schrader et al. | 148/157 X |
| 3,648,593 | 3/1972 | Marshall | 134/64 R X |
| 3,724,826 | 4/1973 | Kubotera et al. | 134/64 R |
| 3,856,281 | 12/1974 | Bertolotti et al. | 134/64 R |
| 3,889,507 | 7/1975 | Kranenberg et al. | 266/113 X |
| 3,921,964 | 11/1975 | Rossi et al. | 266/113 X |
| 3,990,257 | 11/1976 | Taylor et al. | 266/114 X |

*Primary Examiner*—Roy Lake
*Assistant Examiner*—Paul A. Bell
*Attorney, Agent, or Firm*—Bacon & Thomas

[57] ABSTRACT

A water cooling system for quenching rod, billet or bar typically as it leaves a hot mill. The system comprises one or more open ended troughs into which water is fed under pressure through vertical slots in the walls of the trough to provide an agitated bath of water through which the rod, billet or bar travels and is thereby cooled. Sets of angled slots in one end of each trough act to control the flow of water from the trough.

9 Claims, 3 Drawing Figures

COOLING SYSTEMS FOR METAL ARTICLES

Figure 1:
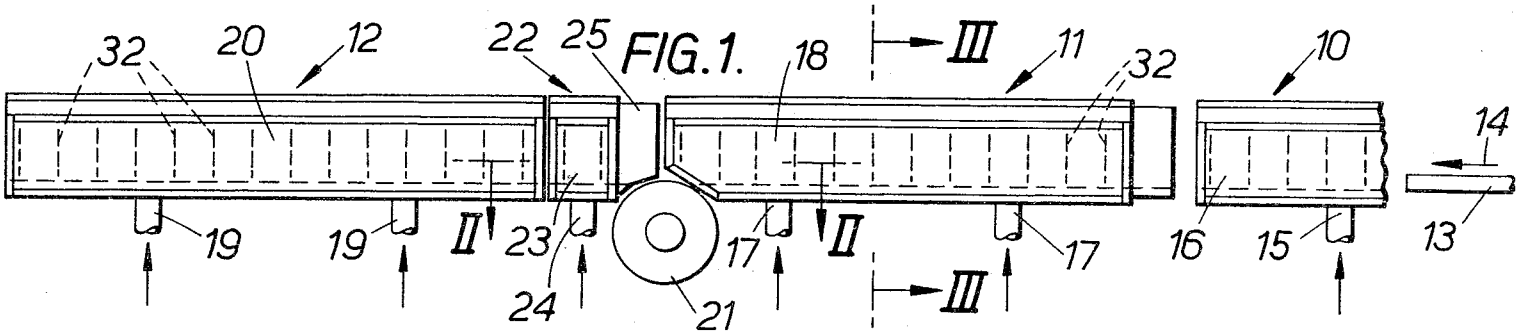

This invention relates to the cooling of metal articles, and in particular to a cooling system for cooling hot-rolled rod, billet, or bar.

One type of cooling system for rod or bar involves taking the hot rolled bar in coiled form and placing it in a bosh or tank containing still water. The coil of metal is usually cooled to the ambient temperature of the water. This technique may also be used for straight billets or bars. It is however very difficult to effect any degree of control over the rate of cooling or the final temperature to which metal is cooled after treatment. Improved control can be achieved by adding soluble chemical compounds to the water to vary its cooling characteristics.

In order to improve the controllability of the cooling of rods a system was developed in which there were a number of boxes containing high pressure water sprays through which the rod passed at speeds which were compatible with those of a modern rod mill. The idea of using the high pressure water sprays was to ensure that the boundary layer of water vapour formed next to the metal surface was continually broken down by the spray itself. The cooling sprays generally operate at pressures between 42 psi and 300 psi. One disadvantage of this system is that very large flows of water are required at considerable pressure in order to effect the cooling. Thus the system is wasteful in terms of energy requirements to pump the water although the water itself can be recycled. A more serious disadvantage of this type of system is that the rod or bar is totally enclosed in the spray box (except for the exit and entry) and when the rod or bar cobbles or otherwise jams in the box, it is extremely difficult to clear the system.

It is an object of the present invention to provide a cooling system which overcomes the disadvantages of the previously described systems.

According to one aspect of the invention a cooling system is provided for cooling hot-rolled rod, billet, or bar, said cooling system including a trough open at its ends to permit entry and exit of the rod, billet, or bar, a first set of inlets positioned along at least one side of the trough to direct water under pressure into the trough, and a second set of inlets situated adjacent at least one end of the trough, said second set of inlets being positioned to direct fluid into the trough so that in use they act to retain water in the trough or to control the flow of water from the trough.

According to another aspect of the invention a method is provided for cooling hot-rolled rod, billet or bar in a trough open at its ends to permit entry and exit of the rod, billet or bar, said method including passing the rod, billet, or bar through the trough, directing water under pressure into the trough through a first set of inlets along at least one side of the trough, and directing fluid through a second set of inlets situated adjacent at least one end of the trough, the fluid being directed through said second set of inlets so as to act to retain water in the trough or to control the flow of water from the trough.

Preferably said second set of inlets are constructed so as to direct fluid into the trough at an acute angle to the direction of the water entering the trough through the first set of water inlets. The fluid directed through the second set of inlets may be water. Alternatively, however, it may be compressed air.

The first set of inlets may be in the form of slots. The slots may be in a substantially vertical plane. The second set of inlets may also be in the form of slots which may be in a substantially vertical plane.

The walls of the trough may be substantially parallel to one another throughout the length of the trough. Alternatively, there may be a section of the trough which has walls which are inclined to one another.

The trough may have a removable cover which in use prevents the bar from rising out of the trough and can also increase the heat transfer efficiency of the system by eliminating the induction of air into the cooling water.

A driven roller may be incorporated between two troughs, said driven roller acting to frictionally drive the bar through the troughs.

The trough walls may be spaced from one another by a distance approximately five times the diameter of the largest rolled billet or bar to be cooled.

An ancillary trough section may be positioned adjacent the exit end of a trough but spaced from the trough by a driven roller, angled inlets being provided in the walls of the ancillary trough section.

Figure 2:
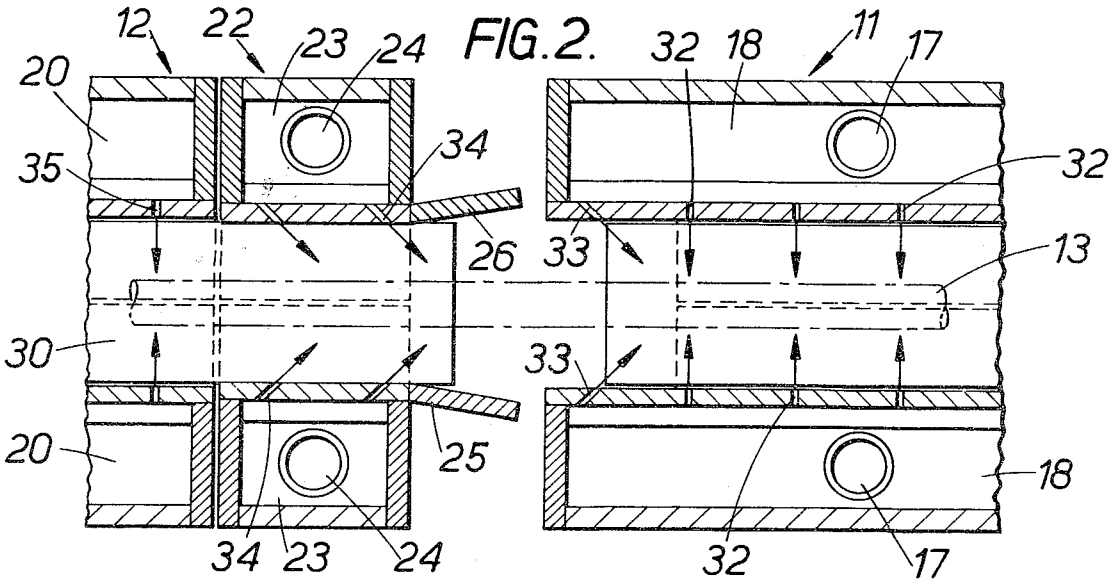
Figure 3:
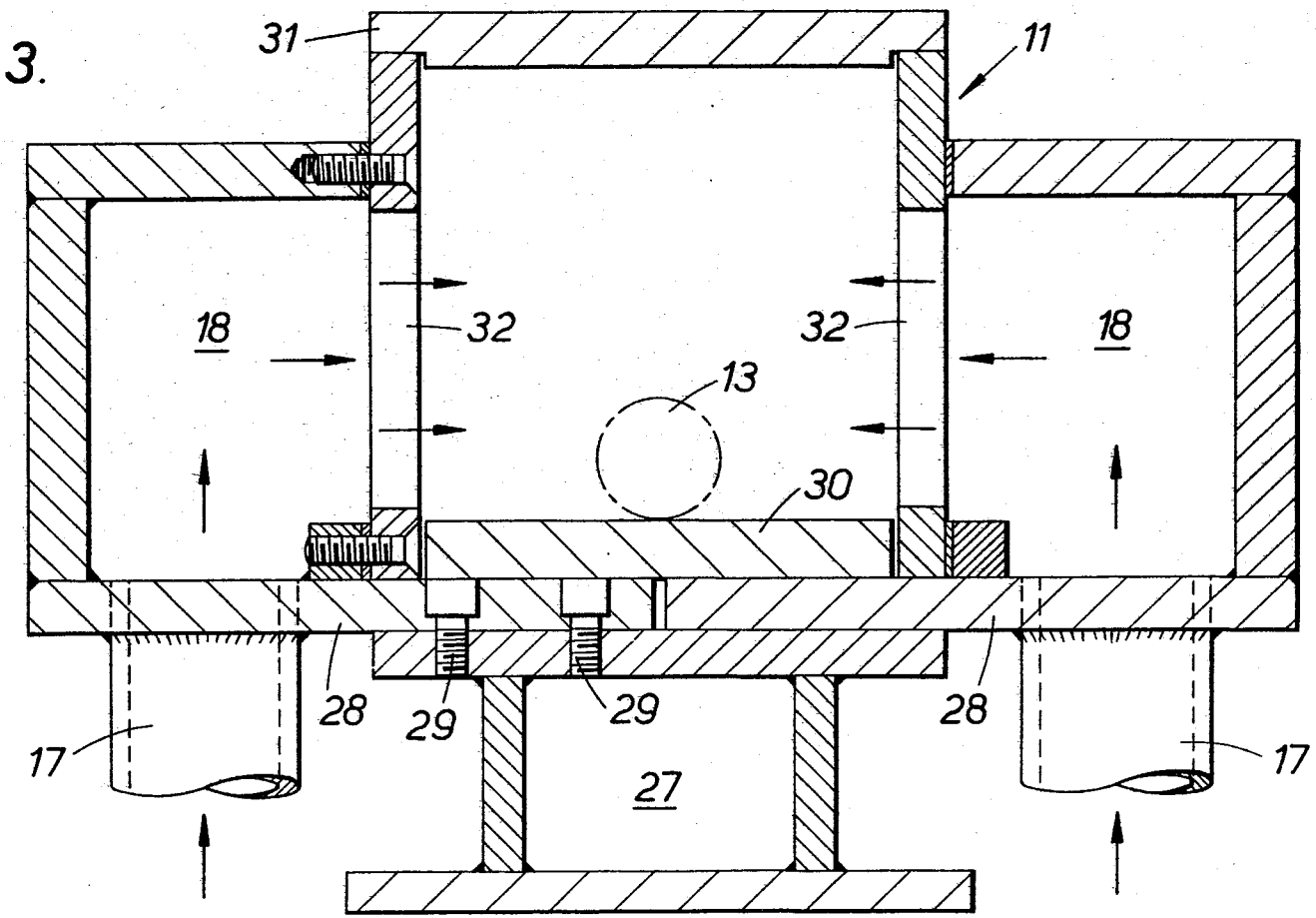

In the accompanying drawing,

FIG. 1 shows in side elevation one embodiment of a cooling system according to the present invention, FIG. 2 shows a view on II—II of FIG. 1, and FIG. 3 shows a view on III—III of FIG. 1.

In FIG. 1, three troughs 10, 11 and 12 respectively are shown. Each trough is of the same width and height and a hot bar 13 passes through the troughs 10, 11 and 12 in the direction indicated by arrow 14. The first trough 10 has cooling water inlets 15 to feeder boxes 16 on each longitudinal side wall of the trough 10. Similarly the second trough 11 has cooling water inlets 17 to feeder boxes 18 along each longitudinal side wall of trough 11, and the third trough 12 has cooling water inlets 19 to feeder boxes 20 along each longitudinal side wall of trough 12. The water inlets 15, 17 and 19 are connected with a water supply means (not shown) which has valve controls enabling the supply to each trough to be controlled independently of the supply to other troughs.

Between the second trough 11 and the third trough 12 is a roller 21 which is driven about its horizontal axis by a drive means which is not shown. An ancillary trough section 22 is located between roller 21 and the third trough 12 and has its own feeder box 23 and water inlet 24 arranged in a similar manner to that of the three troughs 10, 11 and 12. The ancillary trough section 22 has at its end adjacent the second trough 11 two guide plates 25 and 26 extending in a vertical plane but inclined outwardly from the respective walls of trough section 22. Similar guide plates are provided at the entry to each of the first and second troughs 10 and 11 to ensure that the front end of each bar 13 passes into the respective troughs even if it is slightly curved.

Each trough 10, 11 and 12 and the ancillary trough section 22 rest on a support structure 27 seen clearly in FIG. 3 but for purposes of clarity omitted from FIG. 1. A pair of base plates 28 are secured to the support structure 27 by bolts 29. These base plates 28 form the bottom walls of the troughs 10, 11 and 12 and also the bottom wall of the feeder boxes 16, 18 and 20. A smooth plate 30 of width slightly less than that of the troughs lies along the bottom of each trough on base plate 28 to prevent the bar 13 from fouling the bolts 29. The smooth plate 30 in the third trough 12 extends over the base plate 28 of the ancillary trough section 22 and is cut away at the end adjacent the roller 21 so that the cutaway section fits over the surface of roller 21 but is spaced from the surface. Similarly the bottom of each guide plate 25 and 26 at the end of trough 11 adjacent roller 21 is cut away where it fits close to the roller 21. A removable steel cover 31 is fitted on top of each trough to prevent the bar 13 from leaping out of the trough.

Spaced along each side of troughs 10, 11 and 12 and ancillary trough section 22 are a number of vertical slots. These slots, which, as shown in the drawings, are disposed directly opposite one another, permit water to pass from the respective feeder box to the interior of the troughs. This is seen clearly in FIG. 2. In the second trough 11 a number of slots 32 are spaced along each side of the trough so that in use, they direct jets or streams of water in a direction perpendicular to the sides of the trough so that the water jet issuing from one slot impinges directly on the water jet issuing from its opposite slot above and below a bar passing through the trough and thereby create additional turbulence and agitation of the water in the trough. At the end of trough 11 adjacent roller 21 a pair of angled slots 33 are provided one on each side of the trough which direct water jets at an obtuse angle to the direction in which the bar 13 is travelling. Similarly angled slots 34 lie in the sides of the ancillary trough section 22 and direct water jets at an obtuse angle to the direction in which bar 13 is travelling. In the third trough 12, slots 35 are provided in the trough sides which direct water perpendicular to the sides of the trough 12. The end of the third trough 12 which is not shown in FIG. 2 has angled slots similar to those shown at the end of the second trough 11.

In operation cold water under pressure is pumped to the water inlets 15, 17, 19, and 23. The water pressure is such that the cooling water passes from the feeder boxes 16, 18, 20 and 23 through the slots into the respective troughs 10, 11 and 12 and ancillary trough section 22 at a pressure of about 10 psi. Water is thus directed into the troughs through slots 32 and 35 perpendicular to the sides of the troughs, whilst the water directed through angled slots 33 acts to retain water in trough 11. The water from angled slots 34 in the ancillary trough section 22 assist in retaining the water in trough 11 and in the event of the water supply to trough 12 not being required, ensures that water does not flow into trough 12 and, by virtue of a stripping action, ensures that water is not carried over into trough 12 from trough 11 by the movement of the bar.

The bar 13 passing through the troughs is then cooled by the water in the troughs. The pressure of the water entering the troughs is such that water in the trough is maintained in a constant state of agitation, thereby preventing the formation of a boundary layer of steam along the bar passing through the troughs. The water forms an agitated bath in the troughs due to the retaining effects of the water introduced through the angled slots 33 and trough the opposed vertical slots in the side walls of the trough sections.

The water supply to the troughs comprising the cooling system may be controlled so that all or any of the troughs are fed by the water supply. Thus different cooling rates and cooling configurations can be achieved for different sizes and different grades of bar.

Additionally the severity of cooling (heat transfer efficiency) within each cooling trough or stage may be varied by controlling the water supply pressure to the slots, i.e. water flow rate and consequent degree of agitation. Severity of cooling may also be determined by the number of slots on each cooling stage. In this way, at least a fourfold variation in the severity of cooling can be obtained for different sizes and different grades of bar.

We claim:

1. A cooling system for cooling hotrolled rod, billet or bar, said cooling system including a substantially horizontal trough open at its ends to permit entry and exit of the bar, a first set of inlets positioned along at least one side of the trough to direct water under pressure into the trough, said first set of inlets being in the form of vertical slots which direct a flow of water perpendicular to the direction of movement of the bar, and a second set of inlets situated adjacent at least one end of the trough, said second set of inlets being in the form of vertical slots and positioned so as to direct fluid into the trough so that in use they act to retain water in the trough and to control the flow of water from the trough.

2. A cooling system according to claim 1 in which the second set of inlets are constructed so as to direct fluid into the trough at an acute angle to the direction of the water entering the trough through the first set of inlets.

3. A cooling system according to claim 1 in which the walls of the trough are substantially parallel to one another throughout the length of the trough.

4. A cooling system according to claim 1 in which the trough has a removable cover.

5. A cooling system according to claim 1 including two adjacent troughs through which in use the bar passes, in which system a driven roller is incorporated between the two adjacent troughs, said driven roller acting to frictionally drive the bar through the troughs.

6. A cooling system according to claim 1 including an ancillary trough section positioned adjacent to the exit end of a first trough but spaced from said trough, angled water inlets being provided in the walls of the ancillary trough section.

7. A cooling system according to claim 6 including a second trough in line with the first trough, in which the ancillary trough section forms the entry portion of the second trough, the first trough and the ancillary trough section having fluid supply means controllable independently of the second trough.

8. A cooling system according to claim 7 in which a driven roller is provided between the first trough and the ancillary trough section, said driven roller acting to frictionally drive the bar through the troughs.

9. A cooling system according to claim 1 in which a third set of inlets is positioned along the other side of the trough, said third set of inlets being in the form of vertical slots which in use, direct a flow of water perpendicular to the direction of movement of the bar, said first and third set of inlets being directly opposite one another so that the water jet issuing from one slot impinges direclty on the water jet issuing from its opposite slot above and below a bar passing through the trough and thereby create additional turbulence and agitation of the water in the trough.

* * * * *